US008988289B2

(12) United States Patent
Shamblin et al.

(10) Patent No.: US 8,988,289 B2
(45) Date of Patent: Mar. 24, 2015

(54) ANTENNA SYSTEM FOR INTERFERENCE SUPRESSION

(71) Applicants: Jeffrey Shamblin, San Marcos, CA (US); Sebastian Rowson, San Diego, CA (US); Laurent Desclos, San Diego, CA (US)

(72) Inventors: Jeffrey Shamblin, San Marcos, CA (US); Sebastian Rowson, San Diego, CA (US); Laurent Desclos, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 172 days.

(21) Appl. No.: 13/622,356

(22) Filed: Sep. 18, 2012

(65) Prior Publication Data

US 2013/0135162 A1 May 30, 2013

Related U.S. Application Data

(63) Continuation-in-part of application No. 13/029,564, filed on Feb. 17, 2011, now Pat. No. 8,362,962.

(51) Int. Cl.

| | |
|---|---|
| ***H01Q 1/24*** | (2006.01) |
| ***H01Q 9/06*** | (2006.01) |
| ***H01Q 3/00*** | (2006.01) |
| ***H01Q 9/04*** | (2006.01) |

(52) U.S. Cl.

CPC ..... *H01Q 9/06* (2013.01); *H01Q 1/243* (2013.01); *H01Q 3/00* (2013.01); *H01Q 9/0421* (2013.01)

USPC ..... 343/700 MS; 343/745; 343/795; 343/815

(58) Field of Classification Search

CPC ..... H01Q 3/00
USPC ..... 343/700 MS, 745, 795, 815, 834
See application file for complete search history.

(56) References Cited

U.S. PATENT DOCUMENTS

| | | | | |
|---|---|---|---|---|
| 6,307,524 | B1 * | 10/2001 | Britain | 343/795 |
| 6,326,921 | B1 * | 12/2001 | Egorov et al. | 343/700 MS |
| 6,429,818 | B1 * | 8/2002 | Johnson et al. | 343/702 |
| 6,614,400 | B2 * | 9/2003 | Egorov | 343/702 |
| 6,765,536 | B2 * | 7/2004 | Phillips et al. | 343/702 |
| 7,755,547 | B2 * | 7/2010 | Rahola et al. | 343/702 |
| 7,821,470 | B2 * | 10/2010 | Azhari | 343/846 |

* cited by examiner

*Primary Examiner* — Tho G Phan

(74) *Attorney, Agent, or Firm* — Coastal Patent Law Group, P.C.

(57) ABSTRACT

An antenna system is capable of optimizing communication link quality with one or multiple transceivers while suppressing one or multiple interference sources. The antenna provides a low cost, physically small multi-element antenna system capable of being integrated into mobile devices and designed to form nulls in the radiation pattern to reduce interference from unwanted interferers. The antenna system operates in both line of sight and high multi-path environments by adjusting the radiation pattern and sampling the received signal strength to reduce signal levels from interferers while monitoring and optimizing receive signal strength from desired sources.

14 Claims, 14 Drawing Sheets

ANTENNA SYSTEM FOR INTERFERENCE SUPRESSION

CROSS-REFERENCE TO RELATED APPLICATIONS

This application is a continuation-in-part (CIP) of commonly owned U.S. Ser. No. 13/029,564, filed Feb. 17, 2011, titled "ANTENNA AND METHOD FOR STEERING ANTENNA BEAM DIRECTION"; which in turn claims priority to U.S. Ser. No. 12/043,090, filed Mar. 5, 2008, titled "ANTENNA AND METHOD FOR STEERING ANTENNA BEAM DIRECTION", issued as U.S. Pat. No. 7,911,402 on Mar. 22, 2011; the contents of each of which are hereby incorporated by reference.

BACKGROUND OF THE INVENTION

1. Field of the Invention

This invention relates generally to the field of wireless communication. In particular, this invention relates to antenna systems and methods for optimizing communication link quality with intended transceivers.

2. Description of the Related Art

As new generations of handsets, gateways, and other wireless communication devices become embedded with more applications and the need for bandwidth becomes greater, new antenna systems will be required to optimize link quality. Specifically, better control of the radiated field will be required to provide better communication link quality with intended transceivers while suppressing signals from undesired transceivers.

Moreover, as these new handsets and other wireless communication devices become smaller and embedded with increasingly more applications, new antenna designs are required to address inherent limitations of these devices and to enable new capabilities. With classical antenna structures, a certain physical volume is required to produce a resonant antenna structure at a particular frequency and with a particular bandwidth. In multi-band applications, more than one such resonant antenna structure may be required. But effective implementation of such complex antenna arrays may be prohibitive due to size constraints associated with mobile devices. Additionally, it is cost prohibitive in many applications to provide multiple power amplifiers or the feed network required to excite multiple antennas.

A substantial benefit can be realized by nulling out or reducing the antenna gain in the direction of interfering sources. A common technique is to implement an antenna array, with control of the amplitude and phase of the RF signal transmitted or received by the individual antenna elements; a weighting of the signal applied to or received by the elements can be applied that will form reduced gain, or nulls, in the direction of one or multiple interferers.

A goal of this adaptive antenna design is to increase the gain in a direction which results in an improved link budget corresponding to desired connections and reducing interference from unwanted sources when compared to an omnidirectional pattern. Typically, multiple antennas are assembled into an array configuration and a feed network capable of altering the amplitude and phase of the individual antennas is connected to the antennas. An algorithm is developed to modify the composite radiation pattern of the antenna array to shape the antenna beam to increase gain in directions of desired reception or transmission and decrease antenna gain in directions of interfering sources.

The difficulty of this approach is the volume required to integrate multiple antennas in a wireless device along with the complexity of designing and implementing a feed network to distribute the RF signals to multiple antenna elements. A great benefit would be realized by the use of a single driven antenna element that could provide the ability to form nulls in directions of interfering sources.

SUMMARY OF THE INVENTION

In various embodiments, an active tunable antenna is capable of active beam adjustment, configuring the antenna radiation pattern for providing gain maxima in the direction of intended communication and gain minima in the direction of one or multiple interferers. This active tuning is adapted to result in link budget improvement by increasing the intended signal and decreasing the undesirable signals, providing improved signal to noise ratio (SNR) performance.

DETAILED DESCRIPTION OF THE PREFERRED EMBODIMENTS

Figure 1A:
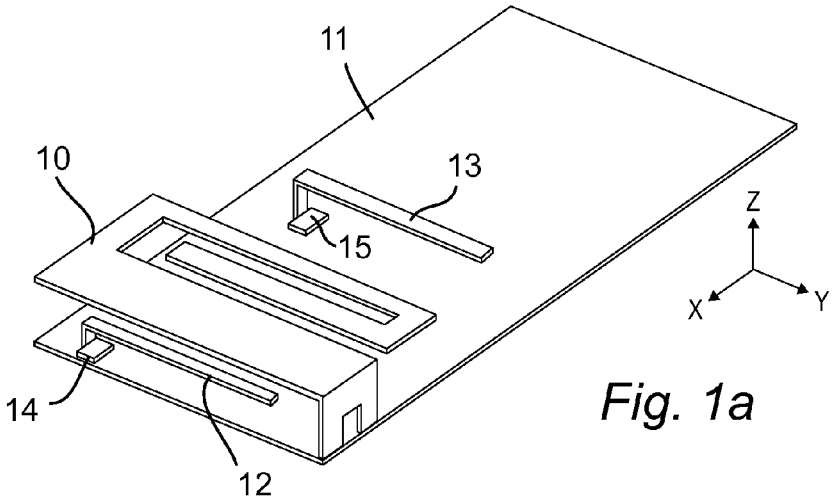
FIG. 1A illustrates an active modal antenna capable of configuring an antenna radiation pattern for providing gain maxima in the direction of intended communication and gain minima in the direction of one or multiple interferers.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

The antenna systems described herein utilize a beam steering technique to reduce interference from one or multiple sources. A platform has been derived to increase the link budget based on the modification of the antenna radiation pattern and is, in part, based upon U.S. Ser. No. 12/043,090, filed Mar. 5, 2008, titled "ANTENNA AND METHOD FOR STEERING ANTENNA BEAM DIRECTION", which issued as U.S. Pat. No. 7,911,402 on Mar. 22, 2011, hereinafter "the '402 patent"; the contents of which are hereby incorporated by reference. The '402 patent describes a structure capable of modifying an antenna radiation pattern, which in the embodiments described herein can be used to provide gain maxima in the direction of intended communication and gain minima in the direction of one or multiple interferers. This will result in link budget improvement by increasing the intended signal and decreasing the undesirable signals, providing improved signal to noise (SNR) performance.

In one embodiment, an antenna system comprises an isolated magnetic dipole (IMD) antenna element, a first parasitic element and a first active tuning element associated with the first parasitic element, and an antenna tuning module (ATM) which provides control signals to the active tuning element for controlling radiating mode of the IMD element. The ATM may comprise a processor and algorithm that alters the radiation pattern of the antenna system to increase communication link quality with the intended transceiver when in the presence of an interfering signal. A receive signal strength indicator (RSSI) or other system metric is sampled from the signal source of interest and the first interferer and the antenna mode is altered to reduce the signal level of the interferer.

In another embodiment, the antenna comprises two or more parasitic elements, an active tuning element associated with each parasitic element, and an antenna tuning module (ATM) which provides control signals to the active tuning elements to alter the radiating mode of the IMD element. The ATM contains a processor and algorithm adapted to alter the radiation pattern of the antenna system to increase communication link quality with the intended transceiver when in the presence of one or multiple interfering signals. The RSSI or other system metric is sampled from the signal source of interest and the interferers and the antenna mode is altered to reduce the signal level of the interferers.

In another embodiment, the algorithm and software used to control the antenna system reside in the antenna tuning module (ATM).

In yet another embodiment, the algorithm and software for controlling the antenna system may reside in the baseband processor or other processor associated with the communication or wireless device.

In certain embodiments, the active tuning element is adapted to provide a split resonant frequency characteristic associated with the antenna, such as for example by shorting the associated parasitic element to ground. The active tuning element may be adapted to rotate the radiation pattern associated with the antenna. This rotation may be effected by controlling the current flow through the parasitic element. In one embodiment, the parasitic element is positioned on a substrate. This configuration may become particularly important in applications where space is the critical constraint. In one embodiment, the parasitic element is positioned at a pre-determined angle with respect to the IMD driven element. For example, the parasitic element may be positioned parallel to the IMD, or it may be positioned perpendicular to the IMD, or at an angle with the IMD driven element. The parasitic element may further comprise multiple parasitic sections. Other driven elements may be utilized, including PIFA and monopole type driven elements although it has been determined that the IMD element is preferable for the embodiments herein.

In another embodiment, the active tuning elements individually comprise at least one of the following: voltage controlled tunable capacitors, voltage controlled tunable phase shifters, FET's, and switches. In other embodiments, similar components for controlling parasitic elements may be utilized as would be understood by those having skill in the art.

In another embodiment, the antenna further includes a third active tuning element associated with the IMD element. This third active tuning element is adapted to tune the frequency characteristics associated with the antenna. This third active element is also controlled by the ATM and is adjusted in unison with the parasitic or parasitics to optimize the antenna system performance.

In certain embodiments a host device may comprise a processor, such as a baseband processor or an applications processor, the processor being adapted to sample the communications link and determine one or more modes of the modal antenna for achieving optimum link quality. The processor can be adapted to send control signals to one or more active elements of a modal antenna, or alternatively to send the control signals to an ATM for communicating with one or more active elements of the modal antenna.

Those skilled in the art will appreciate that various embodiments discussed above, or parts thereof, may be combined in a variety of ways to create further embodiments that are encompassed by the present invention.

The '402 patent referenced above will now be discussed in more detail with reference to certain figures. In sum, a beam steering technique is effectuated with the use of a driven antenna element and one or more offset parasitic elements that alter the current distribution on the driven antenna as the reactive load on the parasitic is varied. More specifically, one or more of the parasitic elements can be positioned for band-switching, i.e. within the antenna volume created by the driven element and the circuit board, and one or more additional parasitic elements may be positioned outside the antenna volume and adjacent to the driven element to effectuate a phase-shift in the antenna radiation pattern. Multiple modes are generated, each mode characterized by the reactance or switching of parasitic elements, and thus this technique can be referred to as a "modal antenna technique", and an antenna configured to alter radiating modes in this fashion can be referred to as an "active multimode antenna" or "active modal antenna".

Figure 1B:
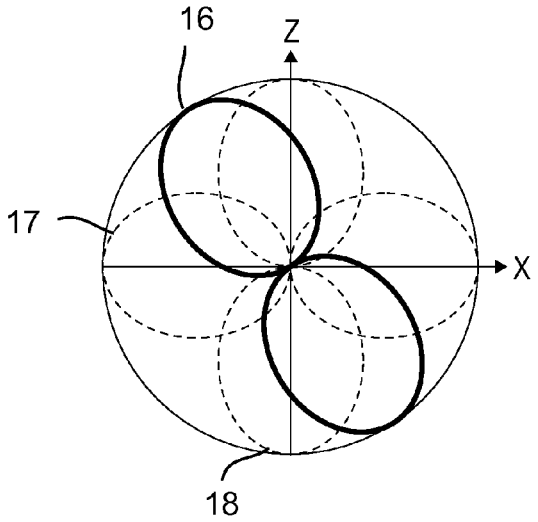
FIG. 1B illustrates various antenna radiation patterns in accordance with a plurality of modes of the antenna as illustrated in FIG. 1A.
Figure 1C:
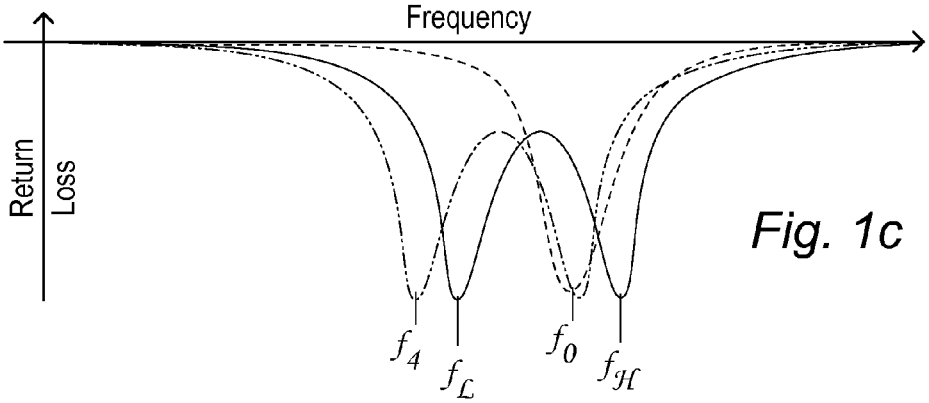
FIG. 1C is a plot of frequency and return loss of the antenna according to FIG. 1A and FIG. 1B.

Now turning to the drawings, FIGS. 1(*a-c*) illustrate an example of an active modal antenna in accordance with the '402 patent, wherein FIG. 1*a* depicts a circuit board 11 and a driven antenna element 10 disposed thereon, a volume between the circuit board and the driven antenna element forms an antenna volume. A first parasitic element 12 is positioned at least partially within the antenna volume, and further comprises a first active tuning element 14 coupled therewith. The first active tuning element 14 can be a passive or active component or series of components, and is adapted to alter a reactance on the first parasitic element either by way of a variable reactance, or shorting to ground, resulting in a frequency shift of the antenna. A second parasitic element 13 is disposed about the circuit board and positioned outside of the antenna volume. The second parasitic element 13 further comprises a second active tuning element 15 which individually comprises one or more active and passive components. The second parasitic element is positioned adjacent to the driven element and yet outside of the antenna volume, resulting in an ability to steer the radiation pattern of the driven antenna element by varying a current flow thereon. This shifting of the antenna radiation pattern is a type of "antenna beam steering". In instances where the antenna radiation pattern comprises a null, a similar operation can be referred to as "null steering" since the null can be steered to an alternative position about the antenna. In the illustrated example, the second active tuning element comprises a switch for shorting the second parasitic to ground when "On" and for terminating the short when "Off". It should however be noted that a variable reactance on either of the first or second parasitic elements, for example by using a variable capacitor or other tunable component, may further provide a variable shifting of the antenna pattern or the frequency response. FIG. 1*c* illustrates the frequency ($f_0$) of the antenna when the first and second parasitic are switched "Off"; the split frequency response ($f_L$,$f_H$) of the antenna when the second parasitic is shorted to ground; and the frequencies ($f_4$; $f_0$) when the first and second parasitic elements are each shorted to ground. FIG. 1*b* depicts the antenna radiation pattern in a first mode 16 when both the first and second parasitic elements are "Off"; in a second mode 17 when only the second parasitic is shorted to ground; and a third mode 18 when both the first and second parasitic elements are shorted "On". Further details of this active modal antenna can be understood upon a review of the '402 patent; however generally one or more parasitic elements can be positioned about the driven element to provide band switching (frequency shifting) and/or beam steering of the antenna radiation pattern which is actively controlled using active tuning elements.

Figure 2A:
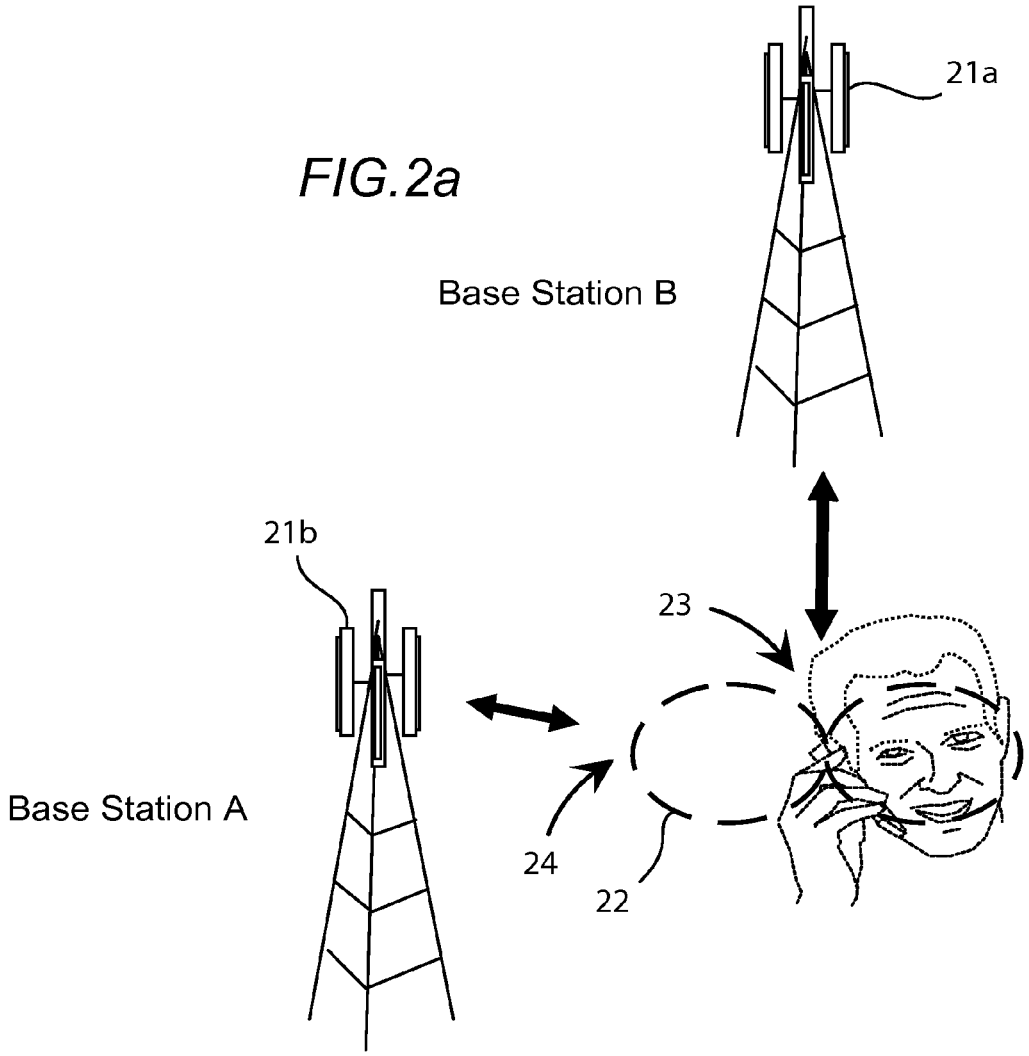
FIG. 2A illustrates a use case of the active modal antenna, the radiation pattern is rotated or altered to optimize link quality for first base station while reducing interference from a second base station.
Figure 2B:
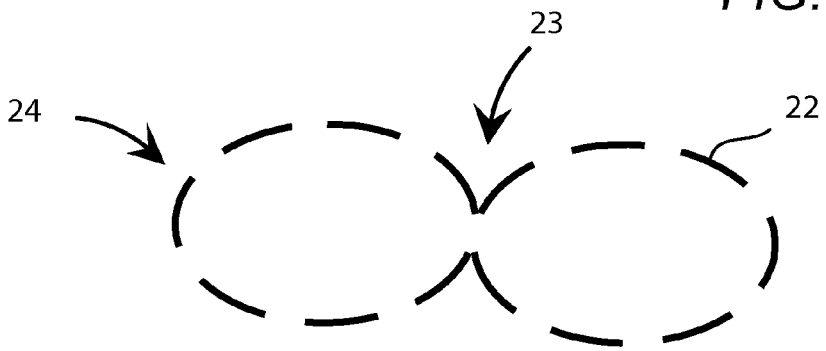
FIG. 2B illustrates a typical radiation pattern of an IMD modal antenna in accordance with an embodiment.

FIG. 2 illustrates a typical use case of the beam steering technique, where the radiation pattern 22 is rotated or altered to optimize link quality for first base station 21*b* while reducing interference from second base station 21*a*. The antenna radiation pattern 22 can be said to comprise a maxima 24 and a minima, or null 23.

Figure 3:
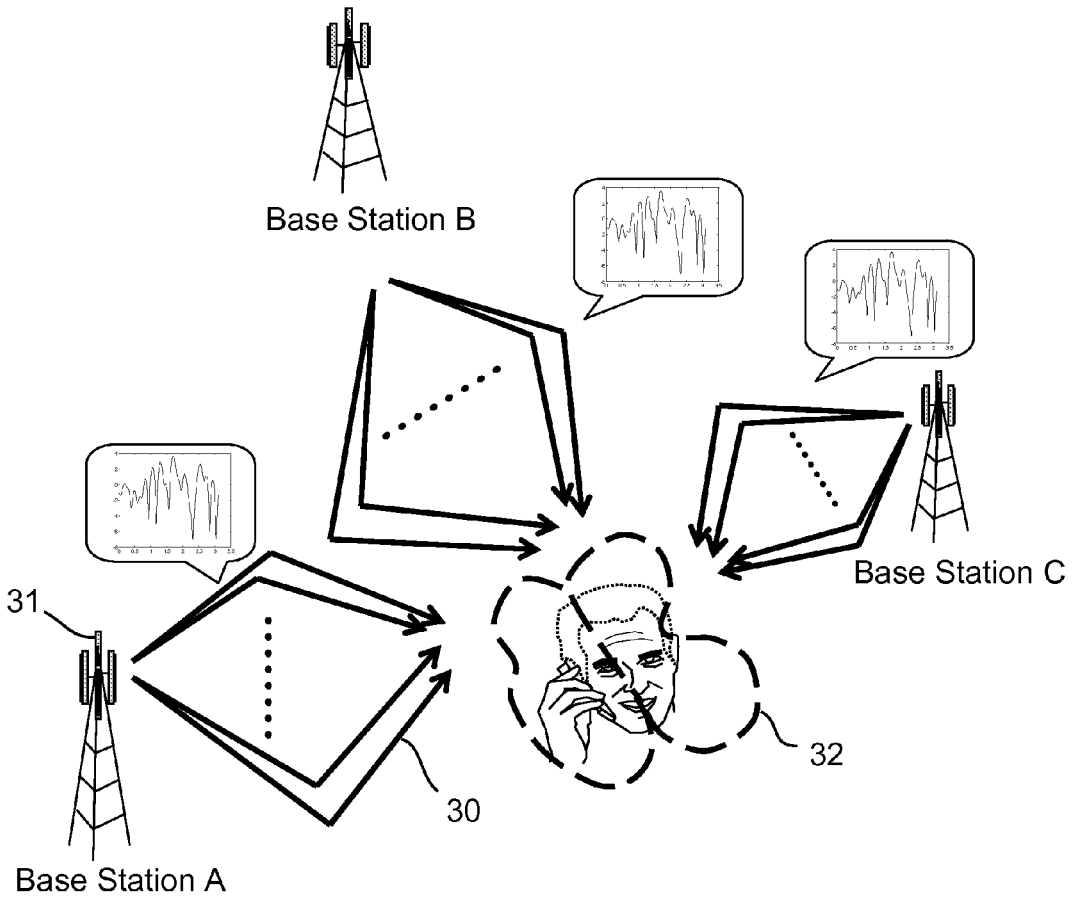
FIG. 3 further illustrates the need for a more capable adaptive antenna system that provides an ability to modify the radiation pattern of the mobile antenna to optimize link quality for multiple transceivers while minimizing interference from multiple sources.

FIG. 3 illustrates the need for a more capable adaptive antenna system that provides the ability to modify the radiation pattern 32 of the mobile antenna to optimize link quality for multiple transceivers while minimizing interference from multiple sources. Base station A 31 transmits a signal 30 to the mobile device, with the signal reflecting off of scatterers, resulting in a composite signal corrupted by the environment.

Figure 4A:
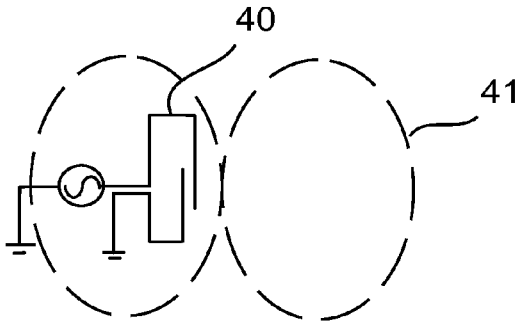
FIGS. 4A-C illustrate an active modal antenna and various antenna radiation patterns achieved by activating parasitic elements positioned about the radiating structure for effectuating beam steering and/or null steering for enhancing link budget quality.
Figure 4B:
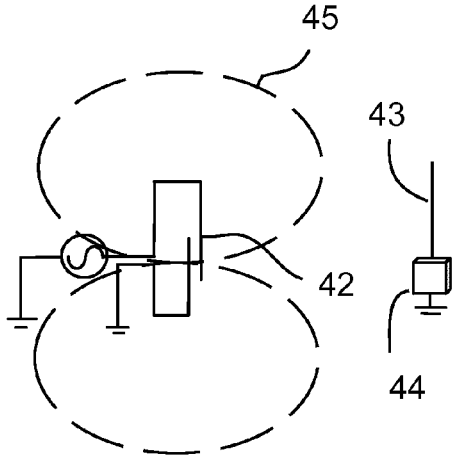
Figure 4C:
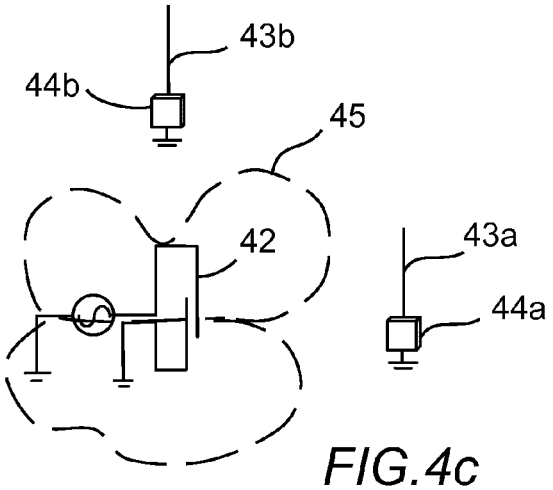

FIG. 4(*a*) illustrates a driven IMD antenna 40 and radiation pattern 41. FIG. 4(*b*) illustrates a driven IMD antenna 42 with parasitic 43 and tuning element 44 along with the resultant radiation pattern 45. The incorporation of a parasitic with active element results in the rotation of the radiation pattern. FIG. 4(*c*) illustrates a second parasitic element 43*b* with active tuning circuit 44*b* positioned in the vicinity of a driven IMD antenna 42. The two parasitic elements 43*a*; 43*b* with active tuning elements 44*a*; 44*b* provide an additional degree of freedom in terms of shaping the radiation pattern 45 compared to the embodiment utilizing a single parasitic element.

Figure 5:
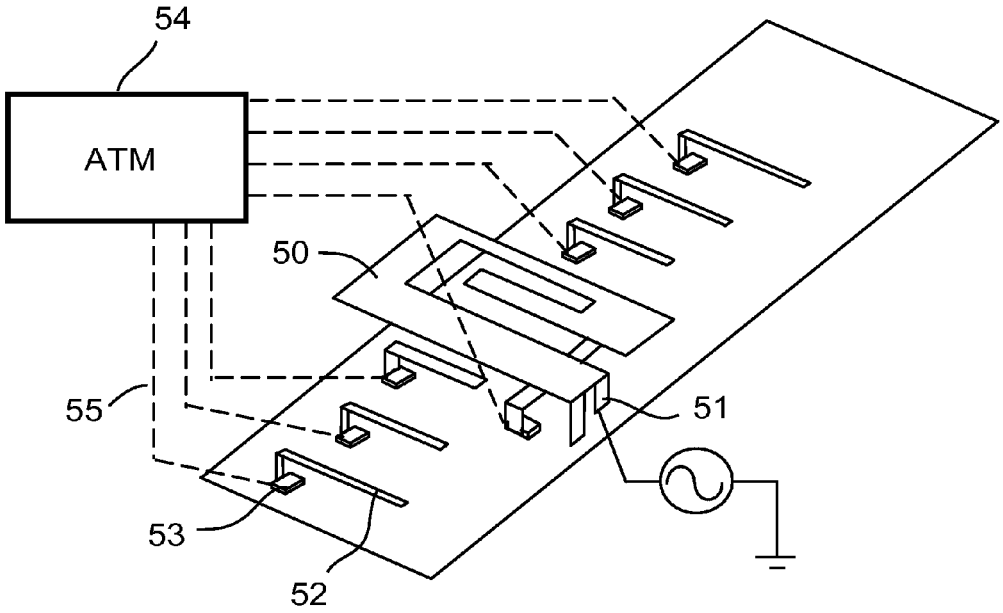
FIG. 5 illustrates an active modal antenna with a single driven antenna element surrounded by numerous parasitic elements and associated active tuning elements in accordance with an embodiment; an antenna tuning module (ATM) provides control signals to the active tuning elements to shape the antenna radiation pattern.

FIG. 5 illustrates an adaptive antenna with a single driven antenna 50 surrounded by parasitic elements 52 with active tuning elements 53. An antenna tuning module (ATM) 54 provides control signals 55 to the active tuning elements to shape the antenna radiation pattern. Up to multiple parasitic elements may be incorporated for producing a number of modes for which the antenna may be configured. The antenna receives a signal from a feed 51 which connects the antenna to a circuit board.

Figure 6:
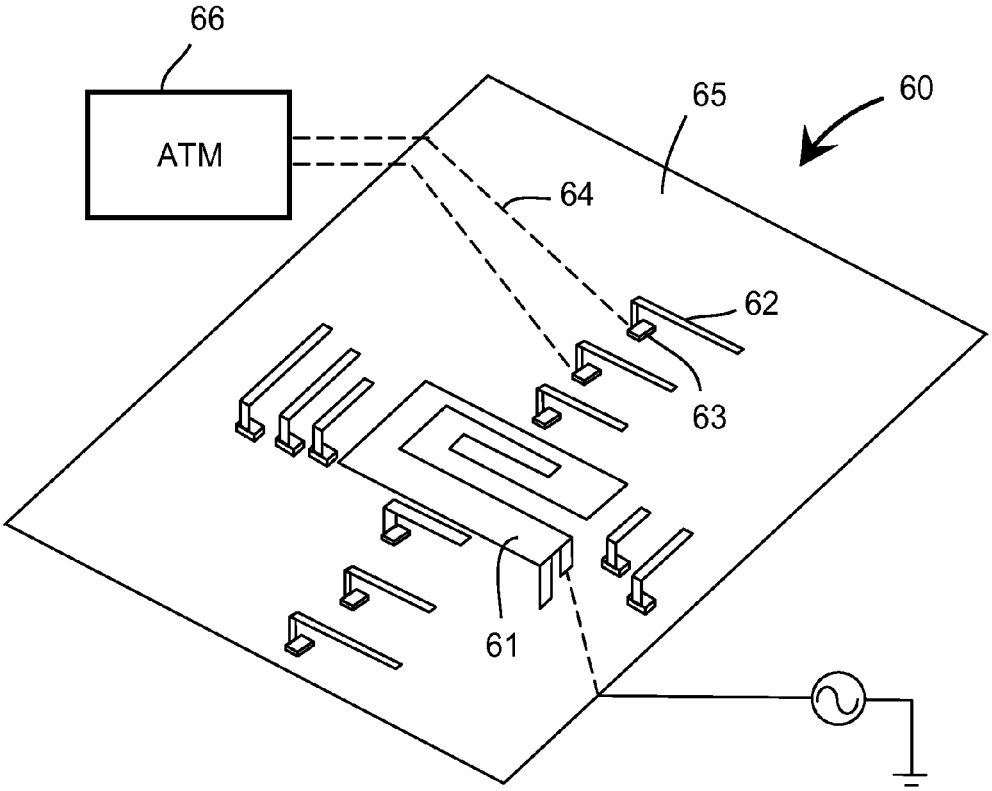
FIG. 6 illustrates an active modal antenna with parasitic elements and associated active tuning elements positioned in two dimensions around the driven antenna structure in accordance with an embodiment; the parasitic elements are controlled by an antenna tuning module.

FIG. 6 illustrates a more capable adaptive antenna system where parasitic elements 62 with active tuning elements 63 are displayed in two dimensions around the driven antenna 61. An antenna tuning module (ATM) 66 provides control signals 64 to the active tuning elements to shape the antenna radiation pattern. The antenna radiator 61 is positioned above a circuit board 65 in such a manner to create an antenna volume therebetween. Parasitic elements may be disposed within the antenna volume for enabling a band-switching or frequency shifting function. Alternatively, one or more parasitic elements may be positioned adjacent to the antenna radiator and outside of the antenna volume for enabling a beam steering function of the antenna.

Figure 7:
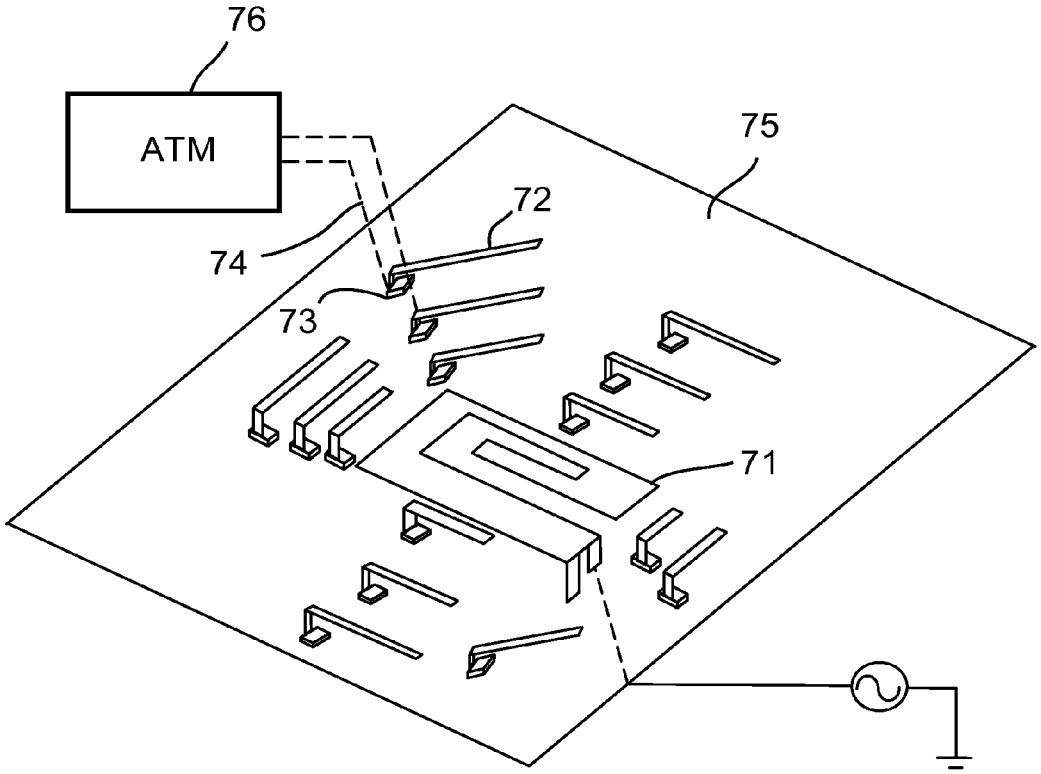
FIG. 7 illustrates an active modal antenna in accordance with an embodiment of the invention.

FIG. 7 illustrates an adaptive antenna system where parasitic elements 72 with active tuning elements 73 are displayed in two dimensions around the driven antenna 71. An antenna tuning module (ATM) 76 provides control signals 74 to the active tuning elements to shape the antenna radiation pattern.

Figure 8:
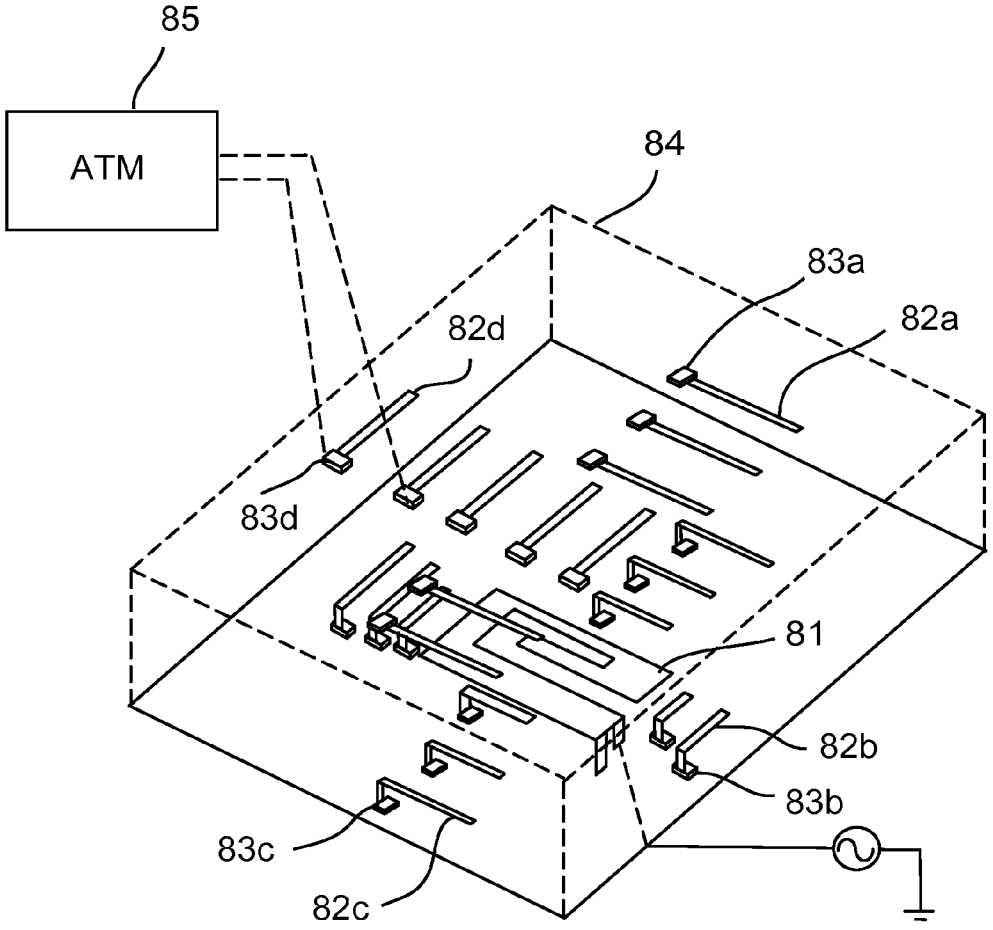
FIG. 8 illustrates an active modal antenna with parasitic elements and associated active tuning elements positioned in three dimensions around a driven antenna element in accordance with an embodiment for providing additional capability in terms of radiation pattern control.

FIG. 8 illustrates an adaptive antenna system where parasitic elements 82(*a-d*) with active tuning elements 83(*a-d*) displayed in three dimensions around the driven antenna 81. An antenna tuning module (ATM) 85 provides control signals to the active tuning elements to shape the antenna radiation pattern. This provides additional capability in terms of radiation pattern control. A substrate can be used to embed the antenna radiator and up to multiple parasitic elements, and up to an additional multiple parasitic elements may be positioned on a surface of the substrate.

Figure 9:
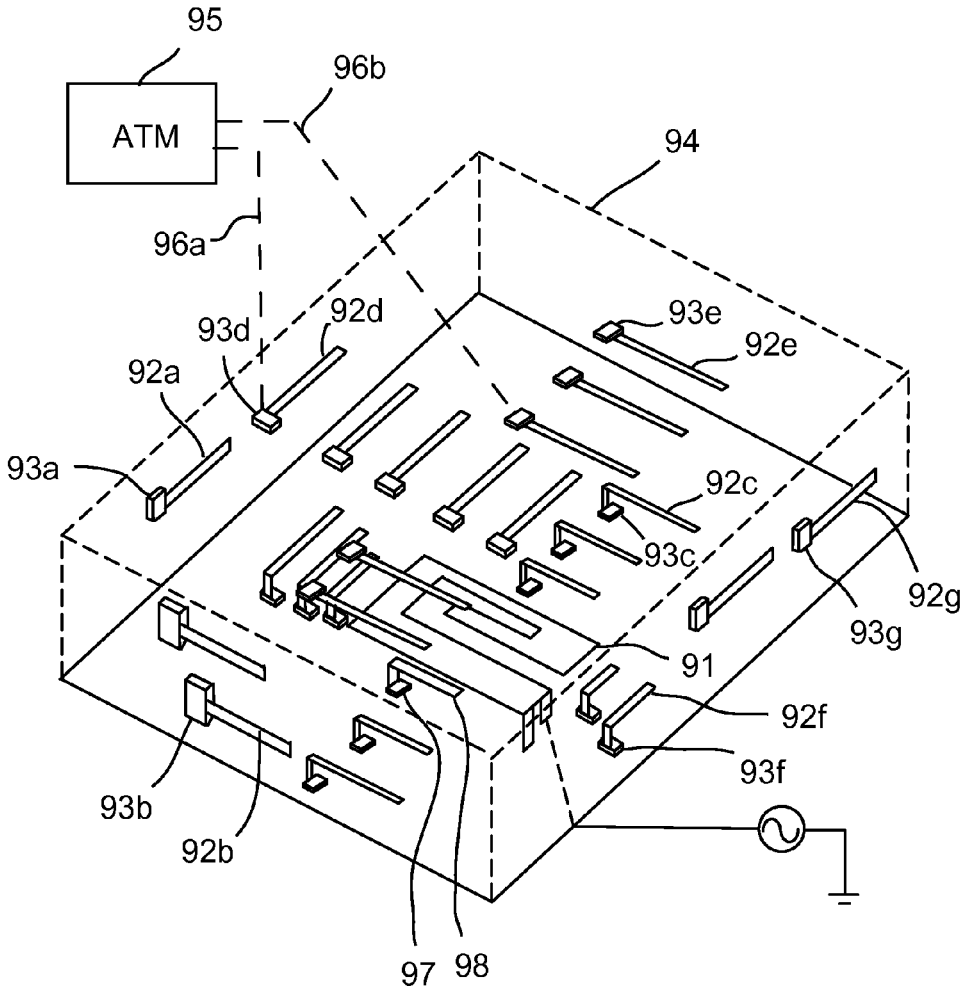
FIG. 9 illustrates an active modal antenna with parasitic elements and associated active tuning elements positioned in three dimensions around the driven antenna in accordance with an embodiment for providing additional capability in terms of radiation pattern control.

FIG. 9 illustrates an adaptive antenna system where parasitic elements 92(*a-g*) coupled to active tuning elements 93(*a-g*), respectively, are displayed in three dimensions around the driven antenna 91. The parasitic elements and active tuning elements are not constrained to planar regions, and may be positioned on a substrate volume 94. An antenna tuning module (ATM) 95 provides control signals 96(*a-b*) to the active tuning elements to shape the antenna radiation pattern. This provides additional capability in terms of radiation pattern control. A band switching parasitic element 98 is positioned with a volume of the antenna and associated with active element 97.

Figure 10:
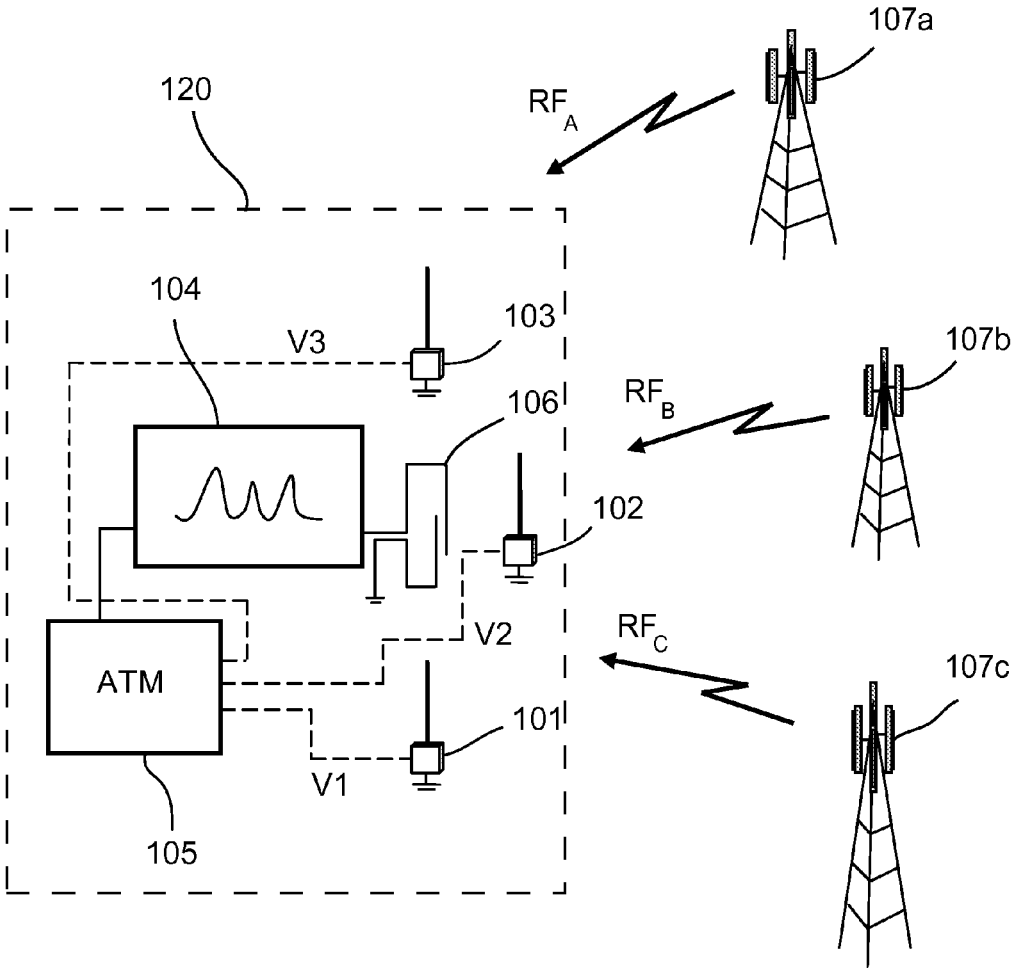
FIG. 10 illustrates an active modal antenna adapted to utilize parasitic elements and associated active tuning elements for radiation pattern control; an adaptive processor analyzes signals from multiple sources and sends control signals to the individual active elements to provide an optimal antenna radiation pattern.

FIG. 10 illustrates an adaptive antenna system that utilizes active elements 101, 102, and 103 connected to parasitic elements, respectively. An adaptive processor 104 analyzes signals from multiple sources 107(*a-c*) and sends control signals V1, V2, V3 to the individual active elements to provide an optimal antenna radiation pattern. An antenna tuning module (ATM) 105 provides the control signals.

Figure 11:
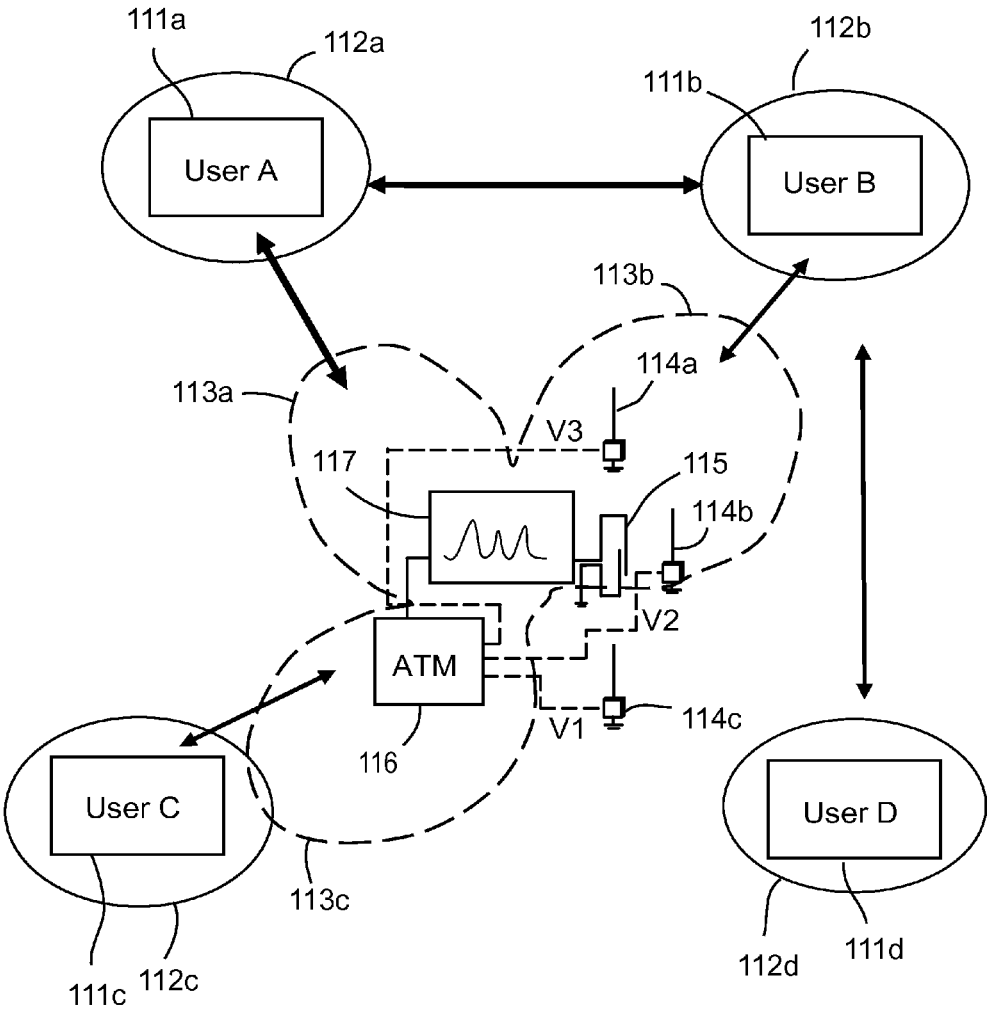
FIG. 11 illustrates another embodiment wherein the active modal antenna is used in a multi-user environment, such as for example a WLAN application; the active modal antenna is capable of shaping the radiation pattern to maximize link quality for intended transceivers while minimizing interference from un-intended transceivers.

FIG. 11 illustrates the adaptive antenna system used in a multi-user environment, such as a WLAN application for example. The adaptive antenna is capable of shaping the radiation pattern 113 of the antenna system to maximize link quality for intended transceivers 111(*a-c*) while minimizing interference from transceiver 111*d*. Transceivers 111(*a-d*) have non-adaptive antenna radiation patterns 112(*a-d*), respectively. The adaptive antenna comprises an antenna radiator 115 and parasitic elements 114(*a-c*) coupled to respective active tuning elements. The antenna radiation pattern is formed into three lobes 113*a*; 113*b*; and 113*c* for increasing a maxima for improving signal communication with users A, B, and C. A null is formed in the radiation pattern in the direction of User D.

Figure 12:
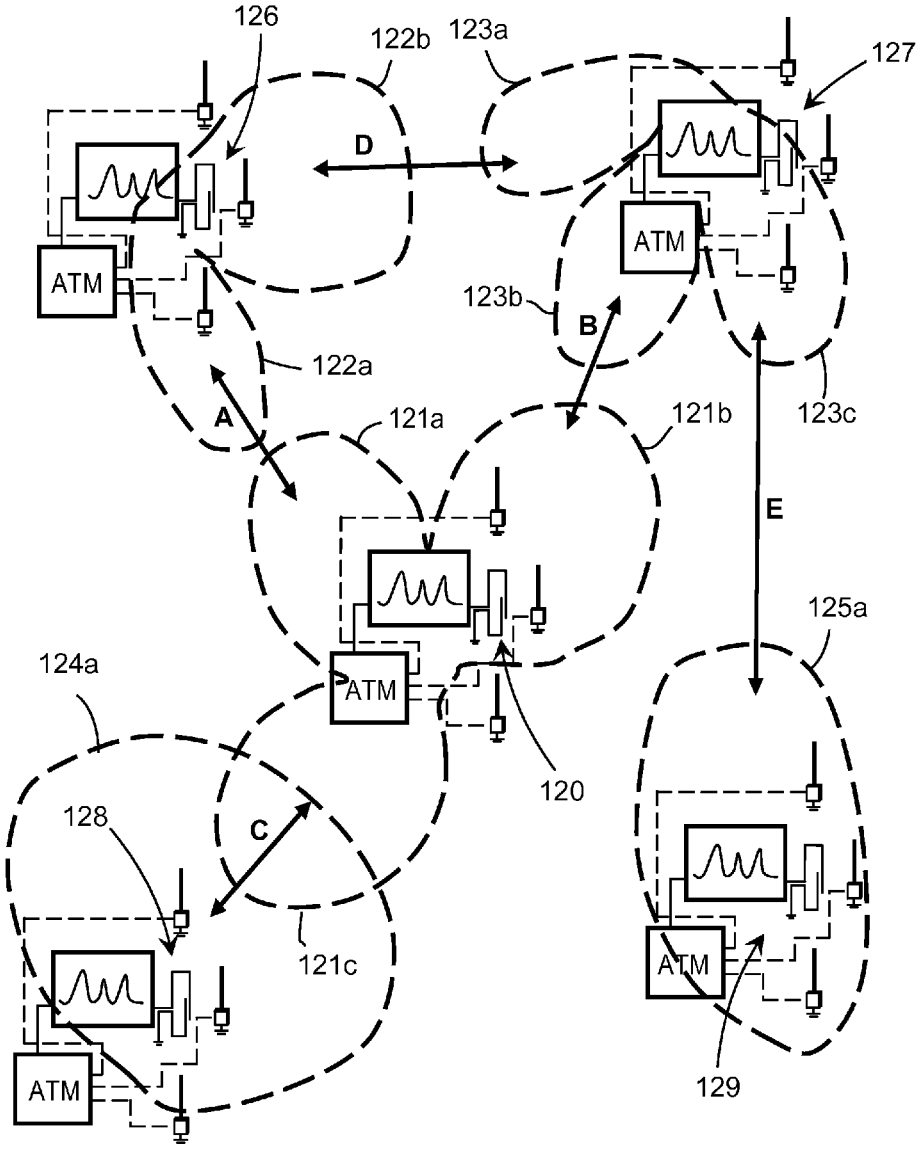
FIG. 12 illustrates a more robust communication system where all users are equipped with active modal antennas; the network of active modal antennas provide improved interference suppression and increased communication link quality.

FIG. 12 illustrates a more robust communication system where all users are equipped with adaptive antenna systems. The system of adaptive antennas provides improved interference suppression and increased communication link quality. The adaptive antenna 120 is capable of shaping the radiation pattern 121 of the antenna system to maximize link quality for intended transceivers 126, 127, and 128 while minimizing interference from transceiver 129. Transceivers 126-129 have adaptive antenna radiation patterns 122; 123; 124; and 125, respectively.

Figure 13:
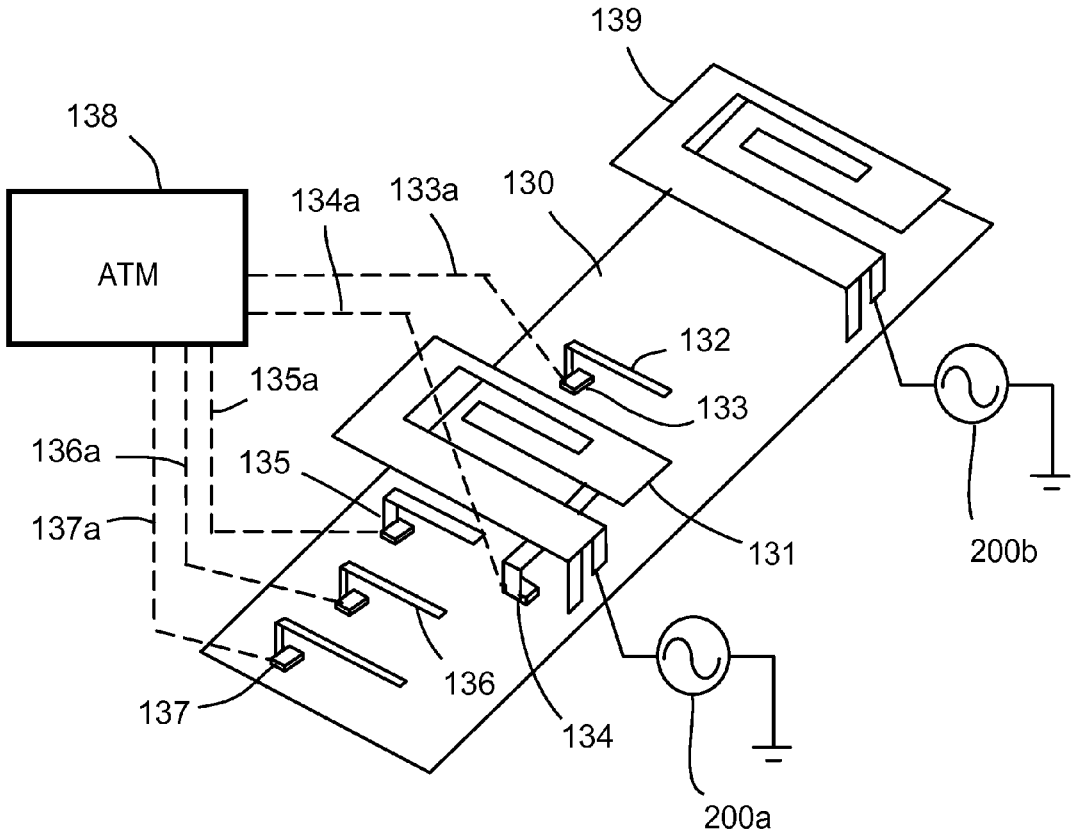
FIG. 13 illustrates an active modal antenna with a first driven antenna connected to a first signal source surrounded by parasitic elements and associated active tuning elements; a second driven antenna is present and connected to a second signal source; and an antenna tuning module (ATM) provides control signals to the active tuning elements to shape the antenna radiation pattern.

FIG. 13 illustrates an adaptive antenna with a first driven antenna 131 connected to a first signal source 200*a* surrounded by parasitic elements 132, 136 with active tuning elements 133, 135, 137. A second driven antenna 139 is present and connected to a second signal source 200*b*. An antenna tuning module (ATM) 138 provides control signals 133*a*; 134*a*; 135*a*; 136*a*; and 137*a* to the active tuning elements to shape the antenna radiation pattern. In this regard, the antenna comprises an active modal antenna 131 and a passive antenna 139.

Figure 14:
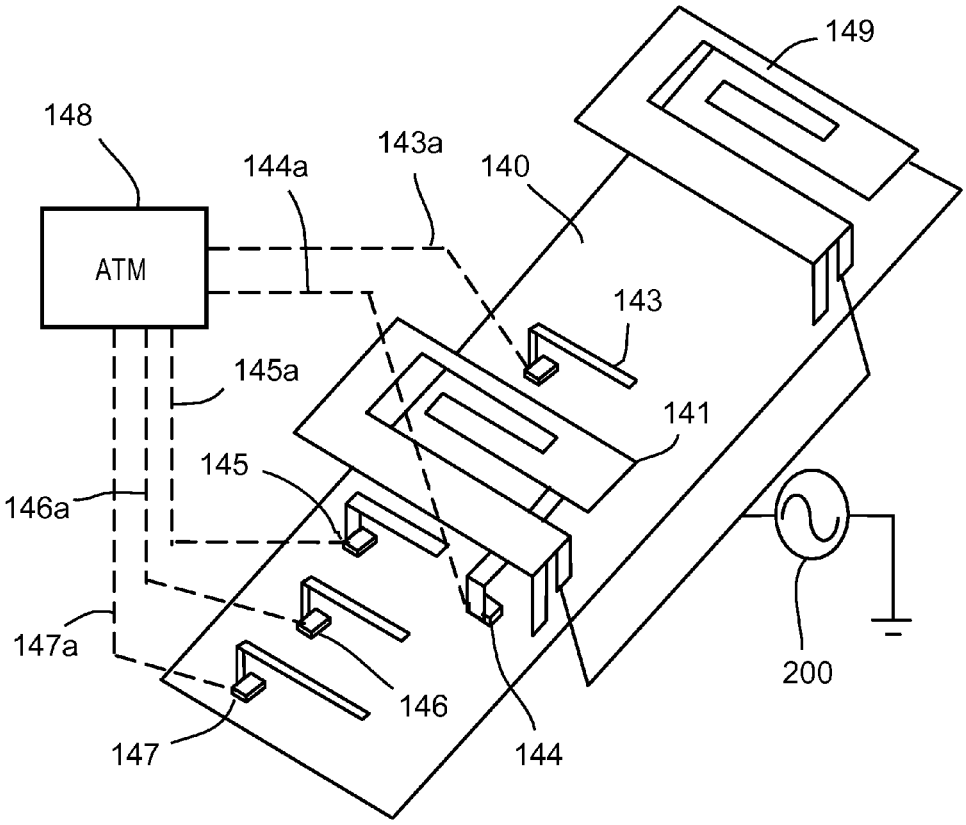
FIG. 14 illustrates the antenna system of FIG. 13, wherein both the active modal antenna and the passive structure are coupled to a shared signal source.

FIG. 14 illustrates an adaptive antenna with a first driven antenna 141 and a second driven antenna 149, both connected to a signal source 200 surrounded by parasitic elements 143 with active tuning elements 144; 145; 146; 147. An antenna tuning module (ATM) 148 provides control signals 143*a*; 144*a*; 145*a*; 146*a*; 147*a* to the active tuning elements to shape the antenna radiation pattern. In this regard, the two antenna radiators share a common feed.

In various embodiments herein, an antenna system comprises one or more active modal antenna and up to multiple passive antennas; the one or more modal antennas each comprise one or more parasitic elements associated with respective active elements. An antenna tuning module is used to send control signals to the active elements for shorting the parasitic to ground thereby inducing a variable current mode of the modal antenna resulting in multiple modes, wherein the antenna comprises a unique antenna radiation pattern in each of the respective modes. The radiation pattern can comprise a maxima or a null, and the maxima can be steered to a source for improving signal whereas the null can be steered toward an interferer for reducing interferences.

The invention claimed is:

1. An antenna system comprising:

a modal antenna comprising an antenna element positioned above a circuit board forming an antenna volume therebetween, one or more first parasitic elements positioned within said antenna volume, and one or more second parasitic elements positioned adjacent to said antenna and outside of said antenna volume, wherein each of said parasitic elements is coupled to an active element for actively configuring one or more modes of the antenna; and an antenna tuning module (ATM) adapted to provide control signals to the active elements for varying the one or more modes of the antenna.

2. The antenna system of claim 1, wherein communication signals from transceivers in the environment are sampled and said control signals are sent to the active tuning elements from the ATM to adjust the antenna radiation pattern for improving communication with the transceivers.

3. The antenna system of claim 1, wherein the radiation pattern is adjusted to reduce the signal level of interfering transceivers and increase the signal level received from intended transceivers.

4. The antenna system of claim 1, wherein the parasitic elements and active elements are positioned around the said antenna element in two dimensions.

5. The antenna system of claim 1, wherein the parasitic elements and active elements are positioned around the said antenna element in three dimensions.

6. The antenna system of claim 1, wherein the antenna element comprises an isolated magnetic dipole (IMD) element.

7. The antenna system of claim 6, wherein a second isolated magnetic dipole (IMD) antenna is introduced into the antenna system, with both IMD antennas connected to ports of a transceiver or separate transceivers;

the active tuning elements associated with the parasitic elements are adjusted to improve performance from the pair of driven IMD antennas to equalize the communication channels.

8. The antenna system of claim 6, wherein a second isolated magnetic dipole (IMD) antenna is introduced into the antenna system; the two antennas are combined to form a two element array; signals from transceivers in the environment are sampled and control signals are sent to the active tuning elements from the ATM to adjust the antenna radiation pattern of the array; and the composite radiation pattern of the two element array is adjusted to reduce the signal level of interfering transceivers and increase the signal level received from intended transceivers.

9. The antenna system of claim 1, wherein the active tuning elements comprise one of: a switch, FET, MEMS device, or a component that exhibits active capacitive or inductive characteristics, or any combination thereof.

10. The antenna system of claim 6, wherein two or more isolated magnetic dipole antennas (IMD) are introduced into the antenna system, with each IMD antenna connected to a separate port of a transceiver or separate transceivers; the active tuning elements connected to the parasitic elements are adjusted to improve performance from the multiple driven IMD antennas to equalize the communication channels.

11. The antenna system of claim 6, wherein two or more isolated magnetic dipole (IMD) antennas are introduced into the antenna system; the multiple antennas are combined to form a multi-element array; signals from transceivers in the environment are sampled and control signals are sent to the active tuning elements from the ATM to adjust the antenna radiation pattern of the array; the composite radiation pattern of the multi-element array is adjusted to reduce the signal level of interfering transceivers and increase the signal level received from intended transceivers.

12. The antenna system of claim 6, where one or more of the antenna elements is not an isolated magnetic dipole antenna.

13. The antenna system of claim 12, wherein the non IMD antenna elements are individually selected from the group consisting of: a monopole, dipole, inverted F antenna (IFA), Planar F antenna (Pifa), and a loop.

14. The antenna system of claim 1, wherein control signals are sent from a processor in the host device to the ATM; the ATM provides control signals to the active tuning elements to adjust the radiation pattern to reduce the signal level of interfering transceivers and increase the signal level received from intended transceivers.

* * * * *